US012454790B2

(12) United States Patent
Song

(10) Patent No.: US 12,454,790 B2
(45) Date of Patent: Oct. 28, 2025

(54) HANDHELD APPLIANCE FOR PRESSING AND STEAMING GARMENTS AND OTHER ITEMS

(71) Applicant: Hamilton Beach Brands, Inc., Glen Allen, VA (US)

(72) Inventor: Brandon Sung-Hwan Song, Glen Allen, VA (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 0 days.

(21) Appl. No.: 18/237,988

(22) Filed: Aug. 25, 2023

(65) Prior Publication Data

US 2024/0076825 A1 Mar. 7, 2024

Related U.S. Application Data

(63) Continuation-in-part of application No. 17/901,246, filed on Sep. 1, 2022, now Pat. No. 11,959,223.

(51) Int. Cl.

| | |
|---|---|
| ***D06F 75/18*** | (2006.01) |
| ***D06F 75/20*** | (2006.01) |
| ***D06F 75/24*** | (2006.01) |
| ***D06F 75/30*** | (2006.01) |

(52) U.S. Cl.

CPC ..... *D06F 75/18* (2013.01); *D06F 75/20* (2013.01); *D06F 75/24* (2013.01); *D06F 75/30* (2013.01)

(58) Field of Classification Search

CPC ..... D06F 75/18; D06F 75/20; D06F 75/24; D06F 75/30; A45D 2001/008; A45D 1/06; A45D 2/36

See application file for complete search history.

(56) References Cited

U.S. PATENT DOCUMENTS

| | | | | | |
|---|---|---|---|---|---|
| 2,880,299 | A * | 3/1959 | Susie | A45D 1/04 | 38/77.8 |
| 4,032,747 | A * | 6/1977 | Kunz | A45D 1/04 | 219/241 |
| 4,817,309 | A * | 4/1989 | Frank | D06F 75/30 | 38/15 |
| 5,280,681 | A * | 1/1994 | Diaw | D06F 71/026 | 38/36 |

(Continued)

FOREIGN PATENT DOCUMENTS

| | | | | |
|---|---|---|---|---|
| DE | 3417254 C | * | 11/1985 | A46B 11/08 |

*Primary Examiner* — Ismael Izaguirre
(74) *Attorney, Agent, or Firm* — Alexander D. Raring

(57) ABSTRACT

A handheld pressing and steaming appliance includes: an upper arm; a lower arm attached at one end to an end of the upper arm; a steam generation unit mounted on the upper arm; a water reservoir located in the upper arm and/or the lower arm; a water pump fluidly connected to the water reservoir and to the steam generation unit; a heating plate mounted near a free end of the upper arm and including a plurality of first exhaust holes that are in fluid communication with the steam generation unit; and a bearing plate mounted on the lower arm at a free end thereof, the bearing plate including a plurality of second exhaust holes. The appliance is movable between open and closed positions. In the closed the second exhaust holes are substantially aligned with the first exhaust holes, such that steam exhausted from the first exhaust holes also passes through the second exhaust holes.

13 Claims, 16 Drawing Sheets

(56) References Cited

U.S. PATENT DOCUMENTS

| | | | | |
|---|---|---|---|---|
| 6,058,834 | A * | 5/2000 | Beckwith | B30B 1/12 100/282 |
| 7,188,442 | B2 * | 3/2007 | Fernandez | D06F 75/40 38/81 |
| 7,640,686 | B2 * | 1/2010 | Wai | D06F 71/02 38/81 |
| 8,757,175 | B1 * | 6/2014 | Leung | A45D 2/001 132/228 |
| 2007/0199574 | A1 * | 8/2007 | Ragosta | A45D 2/002 132/238 |

* cited by examiner

HANDHELD APPLIANCE FOR PRESSING AND STEAMING GARMENTS AND OTHER ITEMS

RELATED APPLICATION

The present application claims priority from and the benefit of U.S. patent application Ser. No. 17/901,246, filed Sep. 1, 2022, the disclosure of which is hereby incorporated herein by reference in full.

FIELD OF THE INVENTION

Examples of the present disclosure generally relate to clothing steam irons and, more particularly, to handheld steam irons with fluid pumps and removable fluid reservoirs.

BACKGROUND

Wrinkled clothing is a problem that any consumer has spent a great deal of time remediating. To alleviate the ever-persistent problem, consumers generally choose between two common wrinkle-removing implements: the iron or the steamer. The iron is a long-used but somewhat cumbersome artifact; for example, a user wishing to iron a garment must retrieve not only the large appliance, but must also retrieve an ironing board or, alternatively, find a flat heat-resistant surface when an ironing board is unavailable. Also, the user must find the appropriate space to store both the iron and corresponding ironing board.

The steamer is another oft-cumbersome appliance that requires a significant amount of storage space. Although the steamer has the advantage of not requiring a solid surface to remove wrinkles, it does generally require a water source, which is not always readily available. Steamers can often make the garment wet instead of merely removing wrinkles in the fabric. Therefore, neither of the most popular wrinkle-removing platforms are optimal when considering the additional resources required, the storage space required, and the inevitable drawbacks of the designs. These problems are only exacerbated for consumers wishing to travel with their wrinkle-removing implement.

One portable option currently available is a portable pressing appliance as discussed in, for example, U.S. Pat. No. 11,168,439 to Toll et al. (the disclosure of which is hereby incorporated herein in its entirety), has a "clamshell" or "alligator clip"-style design, in which two elongate arms are pivotally attached at one end. Heating plates are attached at the free ends of the arms and face each other. A garment or other item to be pressed is positioned between the heating plates, which are then brought together (for example, by squeezing the arms with one hand) to press the item on both sides. Some embodiments may include the capability for forcing steam onto the item as it is pressed between the plates.

It may be desirable to provide an alternative to the Toll et al. design described above that includes enhanced capabilities.

SUMMARY

As a first aspect, embodiments of the invention are directed to a handheld pressing and steaming appliance. The appliance comprises: an upper arm; a lower arm attached at one end to an end of the upper arm; a steam generation unit mounted on the upper arm; a water reservoir located in the upper arm and/or the lower arm; a water pump fluidly connected to the water reservoir and to the steam generation unit; a heating plate mounted near a free end of the upper arm, the heating plate including a plurality of first exhaust holes that are in fluid communication with the steam generation unit; and a bearing plate mounted on the lower arm at a free end thereof, the bearing plate including a plurality of second exhaust holes. The appliance is movable between an open position, in which the heating plate and the bearing plate are separated from each other, and a closed position, in which the heating plate and the bearing plate are closely adjacent to and confront each other. In the closed position at least one of the second exhaust holes is substantially aligned with a respective one of the first exhaust holes, such that steam exhausted from the respective one of the first exhaust holes also passes through the at least one second exhaust hole.

As a second aspect, embodiments of the invention are directed to a handheld pressing and steaming appliance comprising: an upper arm; a lower arm attached at one end to an end of the upper arm; a steam generation unit mounted on the upper arm; a water reservoir located in the upper arm and/or the lower arm; a water pump fluidly connected to the water reservoir and to the steam generation unit; a heating plate mounted near a free end of the upper arm, the heating plate including a plurality of first exhaust holes that are in fluid communication with the steam generation unit; and a bearing plate mounted on the lower arm at a free end thereof. The appliance is movable between an open position, in which the heating plate and the bearing plate are separated from each other, and a closed position, in which the heating plate and the bearing plate are closely adjacent to and confront each other. The appliance further comprises a locking mechanism attached to at least one of the upper and lower arms, the locking mechanism configured to releasably lock the appliance in the closed position.

As a third aspect, embodiments of the invention are directed to a method of steaming an item. The method comprises: (a) providing a handheld appliance comprising: an upper arm; a lower arm attached at one end to an end of the upper arm; a steam generation unit mounted on the upper arm; a water reservoir located in the upper arm and/or the lower arm; a water pump fluidly connected to the water reservoir and to the steam generation unit; a heating plate mounted near a free end of the upper arm, the heating plate including a plurality of first exhaust holes that are in fluid communication with the steam generation unit; and a bearing plate mounted on the lower arm at a free end thereof, the bearing plate including a plurality of second exhaust holes; (b) generating steam with the steam generation unit; (c) moving the upper arm toward the lower arm to bring the heating plate closely adjacent to the bearing plate; and (d) passing steam from the steam generation unit through the first holes and through at least one of the second plurality of holes and onto an item to be steamed.

As a fourth aspect, embodiments of the invention are directed to a handheld pressing and steaming appliance comprising: an upper arm; a lower arm attached at one end to an end of the upper arm; a steam generation unit mounted on the upper arm; a water reservoir located in the upper arm and/or the lower arm; a water pump fluidly connected to the water reservoir and to the steam generation unit; a heating plate mounted near a free end of the upper arm, the heating plate including a plurality of first exhaust holes that are in fluid communication with the steam generation unit; and a bearing plate mounted on the lower arm at a free end thereof, the bearing plate including a plurality of second exhaust holes. The appliance is movable between an open position, in which the heating plate and the bearing plate are separated from each other, and a closed position, in which the heating plate and the bearing plate are closely adjacent to and confront each other. In the closed position at least one of the second exhaust holes is substantially aligned with a respective one of the first exhaust holes, such that steam exhausted from the respective one of the first exhaust holes also passes through the at least one second exhaust hole. The appliance further comprises a closing mechanism attached to at least one of the upper and lower arms, the closing mechanism configured to releasably move the appliance to the closed position.

As a fifth aspect, embodiments of the invention are directed to a handheld pressing and steaming appliance comprising: an upper arm; a lower arm pivotally attached at one end to an end of the upper arm at a pivot; a steam generation unit mounted on the upper arm; a water reservoir located in the lower arm; a water pump fluidly connected to the water reservoir and to the steam generation unit; a heating plate mounted near a free end of the upper arm opposite the pivot, the heating plate including a plurality of first exhaust holes that are in fluid communication with the steam generation unit; and a bearing plate mounted on the lower arm at a free end opposite the pivot, the bearing plate including a plurality of second exhaust holes. The appliance is pivotable between an open position, in which the heating plate and the bearing plate are separated from each other, and a closed position, in which the heating plate and the bearing plate are closely adjacent to and confront each other. In the closed position each of the second exhaust holes is substantially aligned with a respective one of the first exhaust holes, such that steam exhausted from each of the first exhaust holes also passes through a corresponding one of the second exhaust holes.

As a sixth aspect, embodiments of the invention are directed to a method of steaming an item. The method comprises: (a) providing a handheld appliance comprising: an upper arm; a lower arm attached at one end to an end of the upper arm; a steam generation unit mounted on the upper arm; a water reservoir located in the upper arm and/or the lower arm; a water pump fluidly connected to the water reservoir and to the steam generation unit; a heating plate mounted near a free end of the upper arm, the heating plate including a plurality of first exhaust holes that are in fluid communication with the steam generation unit; and a bearing plate mounted on the lower arm at a free end thereof, the bearing plate including a plurality of second exhaust holes; (b) generating steam with the steam generation unit; (c) moving the upper arm toward the lower arm to bring the heating plate closely adjacent to the bearing plate; (d) locking, with a locking mechanism, the upper arm relative to the lower arm to lock the appliance in closed position; and (e) passing steam from the steam generation unit through the first exhaust holes and through at least one of the second plurality of exhaust holes and onto an item to be steamed.

DETAILED DESCRIPTION

Figure 1:
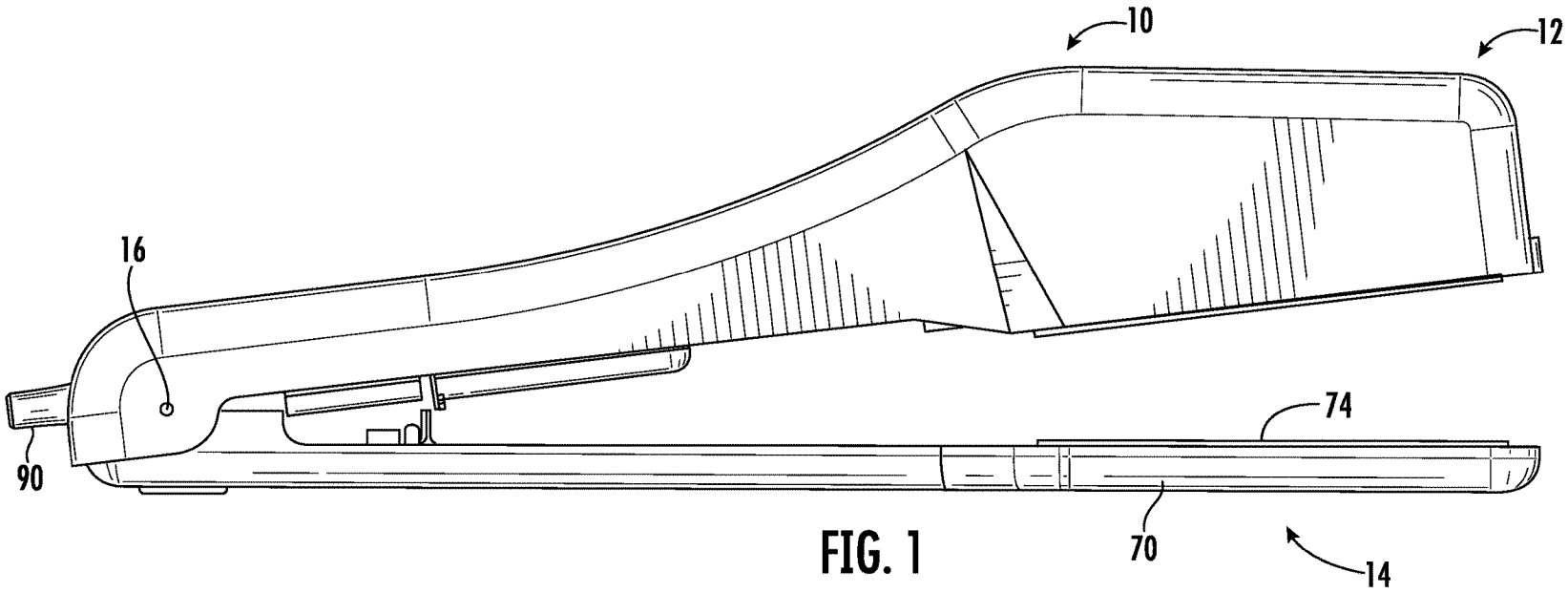
FIG. 1 is a side view of a handheld pressing and steaming appliance according to embodiments of the invention, with the appliance shown in its open position.
Figure 2:
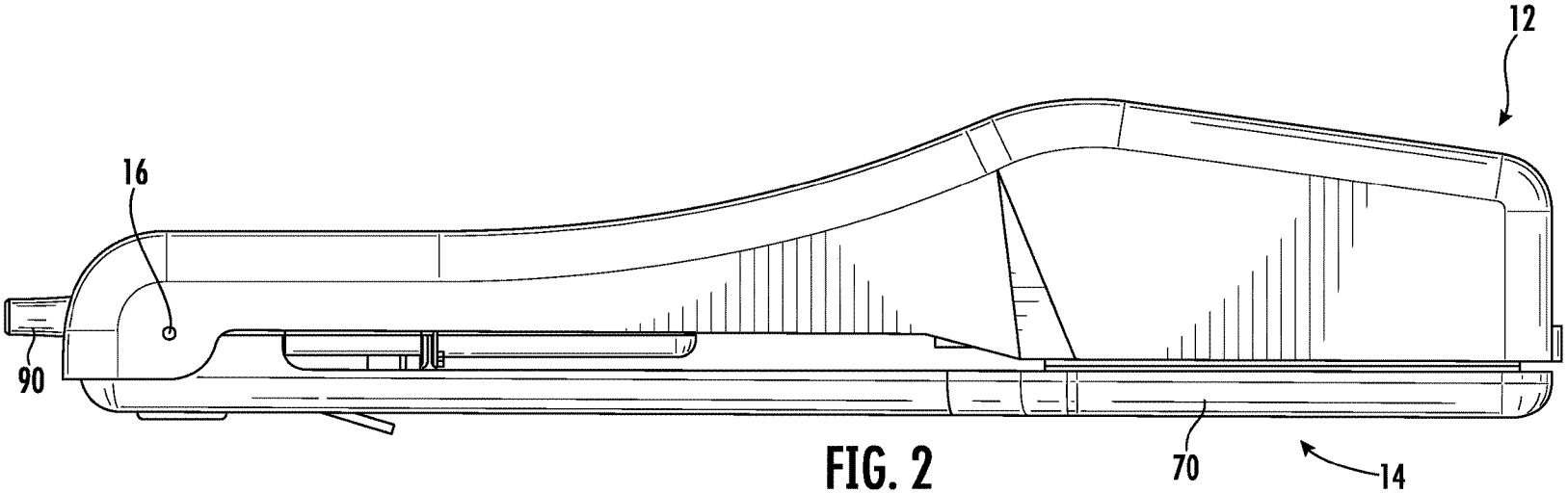
FIG. 2 is a side view of the appliance of FIG. 1 shown in its closed position.

The present invention is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

It will also be understood that, as used herein, the terms "example," "exemplary," and derivatives thereof are intended to refer to non-limiting examples and/or variants embodiments discussed herein, and are not intended to indicate preference for one or more embodiments discussed herein compared to one or more other embodiments.

Referring now to the drawings, a handheld pressing and steaming appliance, designated broadly at 10, is shown in FIGS. 1-9. The appliance 10 includes an upper arm 12 and a lower arm 14 that is pivotally attached to the upper arm at a pivot defined by a pin 16. The upper and lower arms 12, 14 are free to pivot relative to each other about an axis A defined by the pin 16 between an open position (shown in FIG. 1) and a closed position (shown in FIG. 2). In the open position of FIG. 1, the appliance 10 is free to receive a garment or other item to be pressed between heating plates in the arms 12, 14 (described below). In the closed position of FIG. 2, the appliance 10 can be used to press wrinkles from a garment or other item residing between the heating plates, or may be employed as a handheld steamer. The components and operation of the appliance are described in greater detail below.

Figure 3:
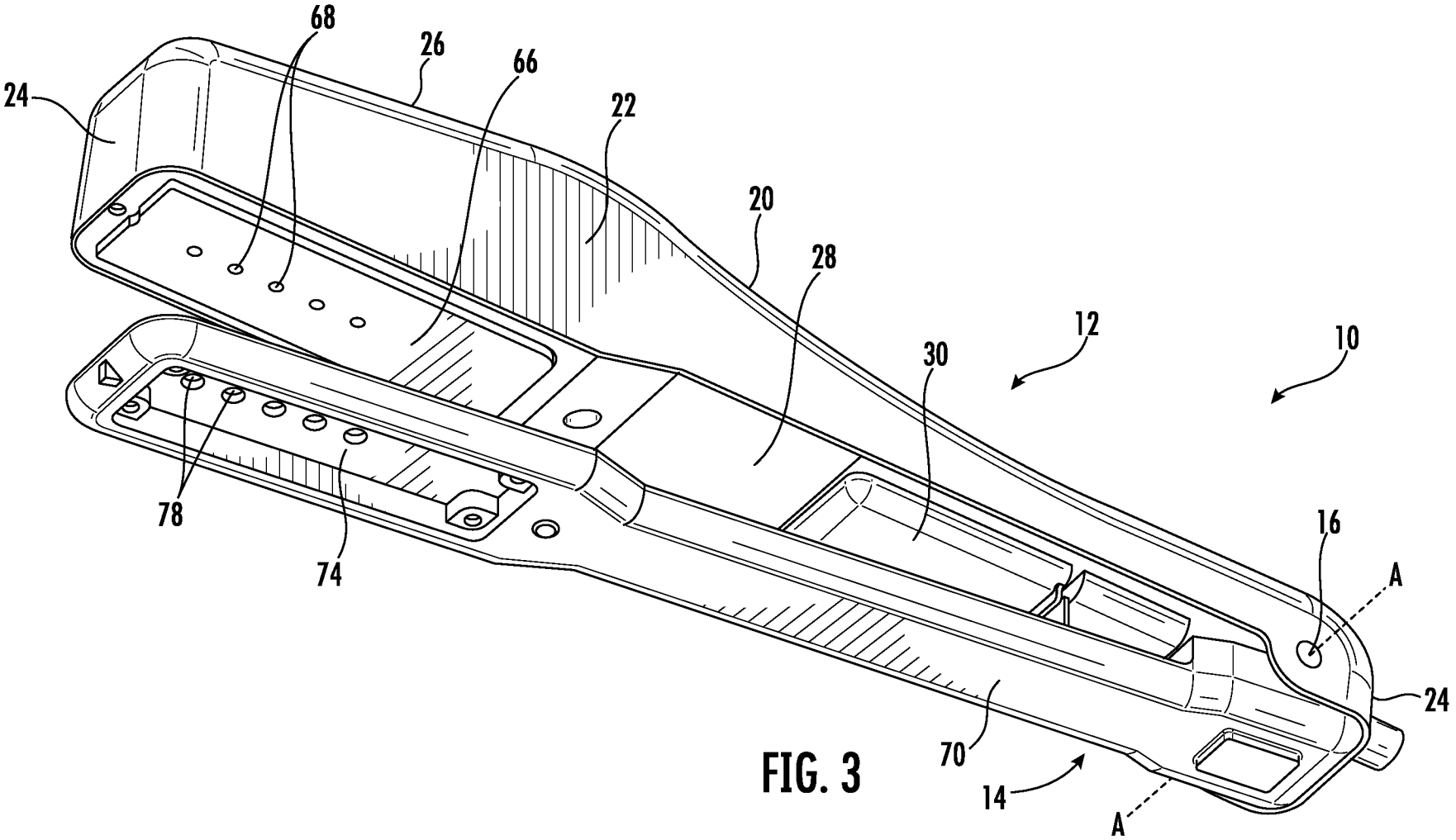
FIG. 3 is a bottom perspective view of the appliance of FIG. 1 in the open position.
Figure 4:
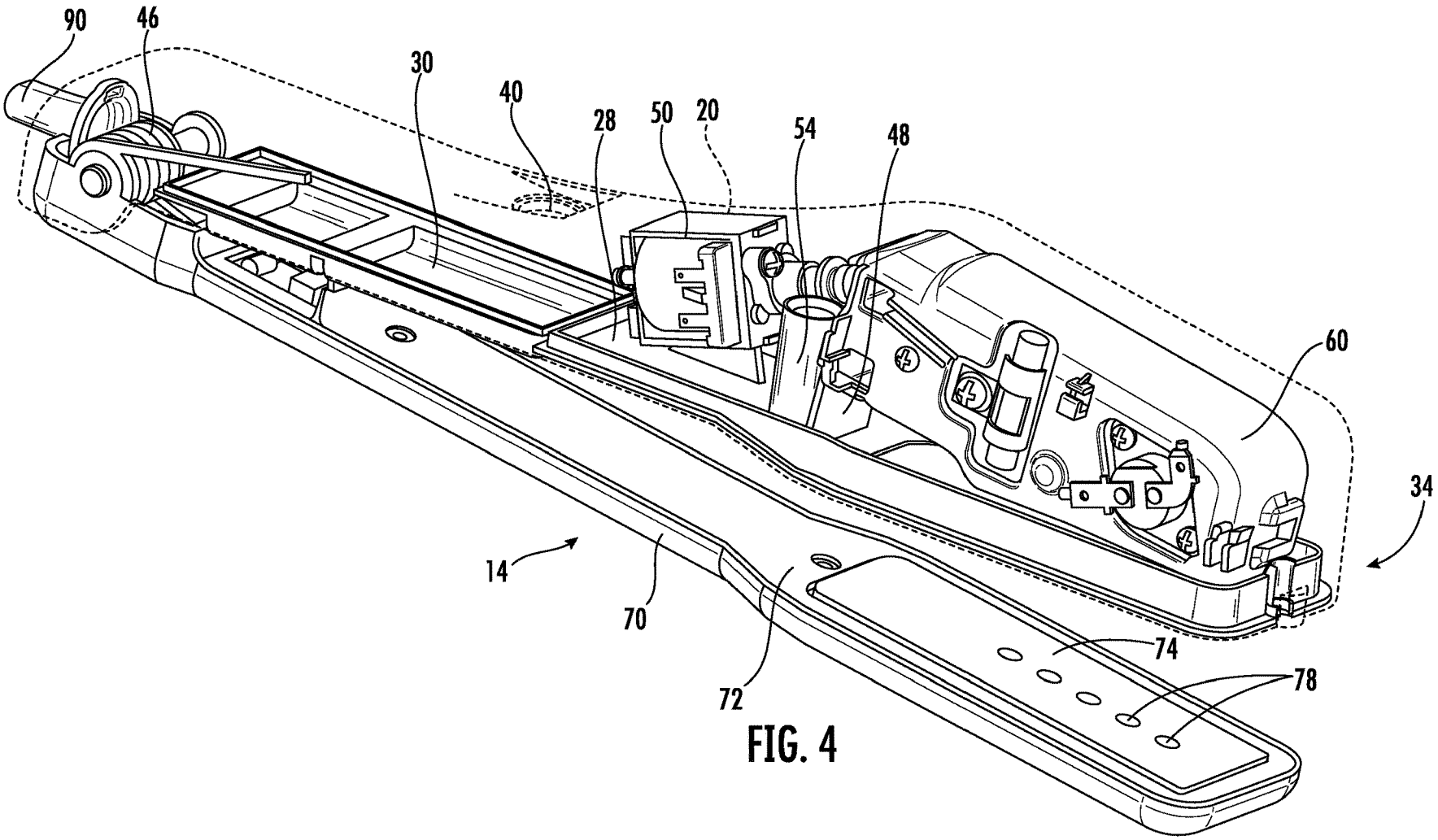
FIG. 4 is a top perspective view of the appliance of FIG. 1 in the open position, with the upper housing shown as transparent.

Referring now to FIGS. 3 and 4, the upper arm 12 includes an upper housing 20 having a side walls 22, end walls 24, and a ceiling 26. The upper arm 12 also has front and rear floors 28, 30. Together, the upper housing 20 and the front and rear floors 28, 30 form an overall housing 34 of the upper arm 12.

Referring to FIGS. 4-6 and 8, the rear floor 30 extends forwardly to a divider 36 that extends downwardly from an intermediate location on the upper housing 20. The divider 36, the rear portion of the upper housing 20, and the rear floor 30 define a water reservoir 38. An inlet opening 40 is located in the upper housing 20 just rearward of the divider 36. A short hose 42 extends from the reservoir 38 through a hole 44 in the divider 36 to provide water for steam generation.

Figure 5:
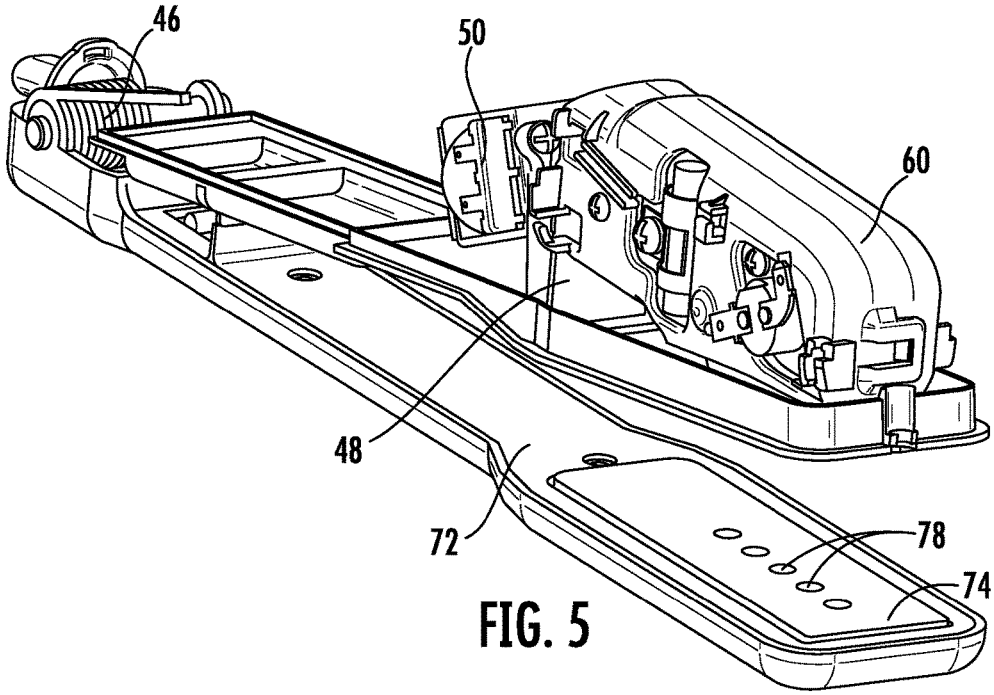
FIG. 5 is a top perspective view of the appliance of FIG. 1 in the open position, with the upper housing removed.
Figure 6:
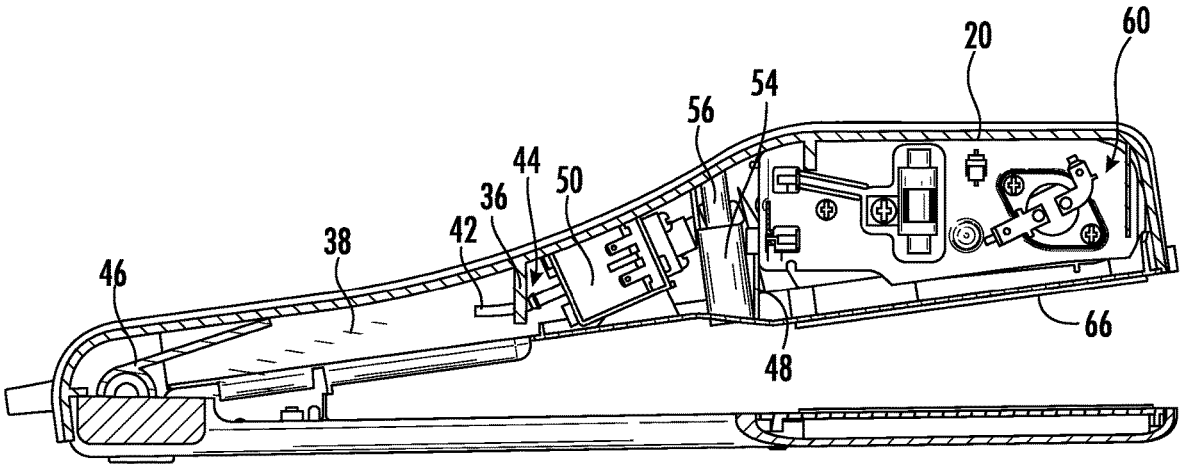
FIG. 6 is a side section view of the appliance of FIG. 1.
Figure 7:
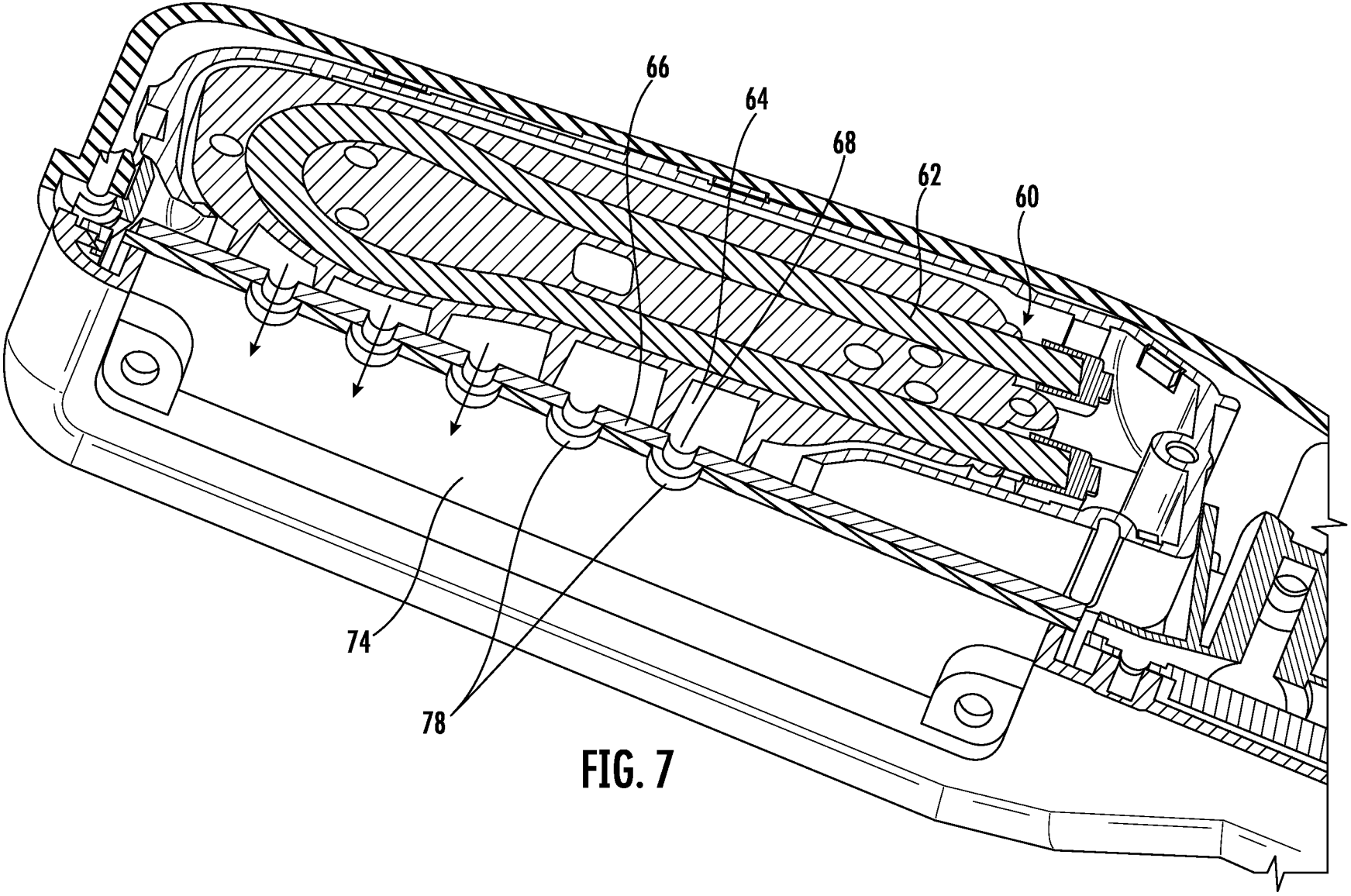
FIG. 7 is an enlarged partial section view of the upper and lower arms of the appliance of FIG. 1 in the closed position, showing how steam can be expelled through the bottom plate to enable the appliance to perform as a steamer.
Figure 8:
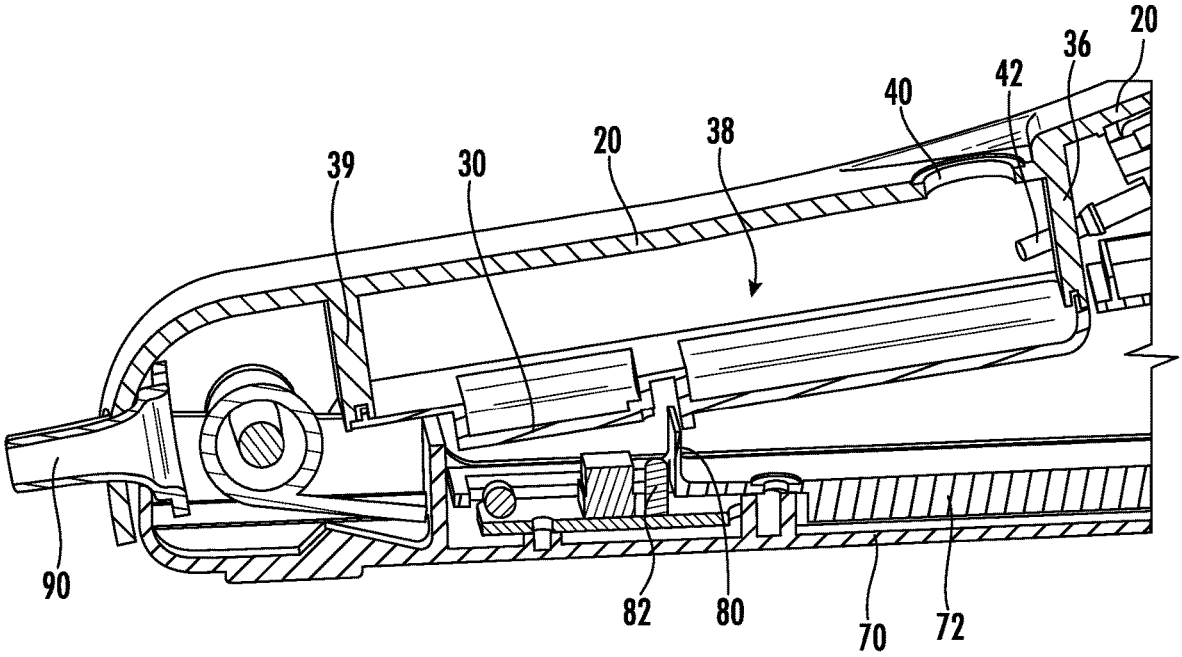
FIG. 8 is an enlarged partial side section view of the appliance of FIG. 1, shown in the open position, that illustrates the water reservoir employed by the steam generation unit.
Figure 9:
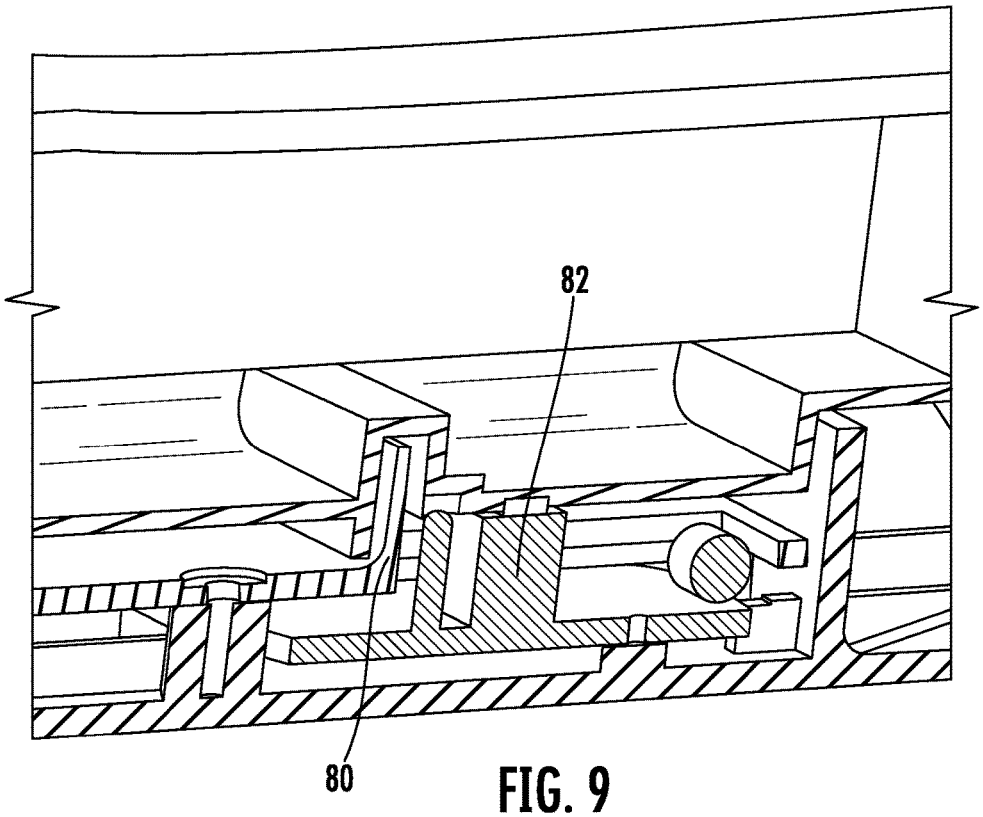
FIG. 9 is a greatly enlarged side partial section view of the appliance of FIG. 1 showing a switch that activates the steam function.
Figure 10:
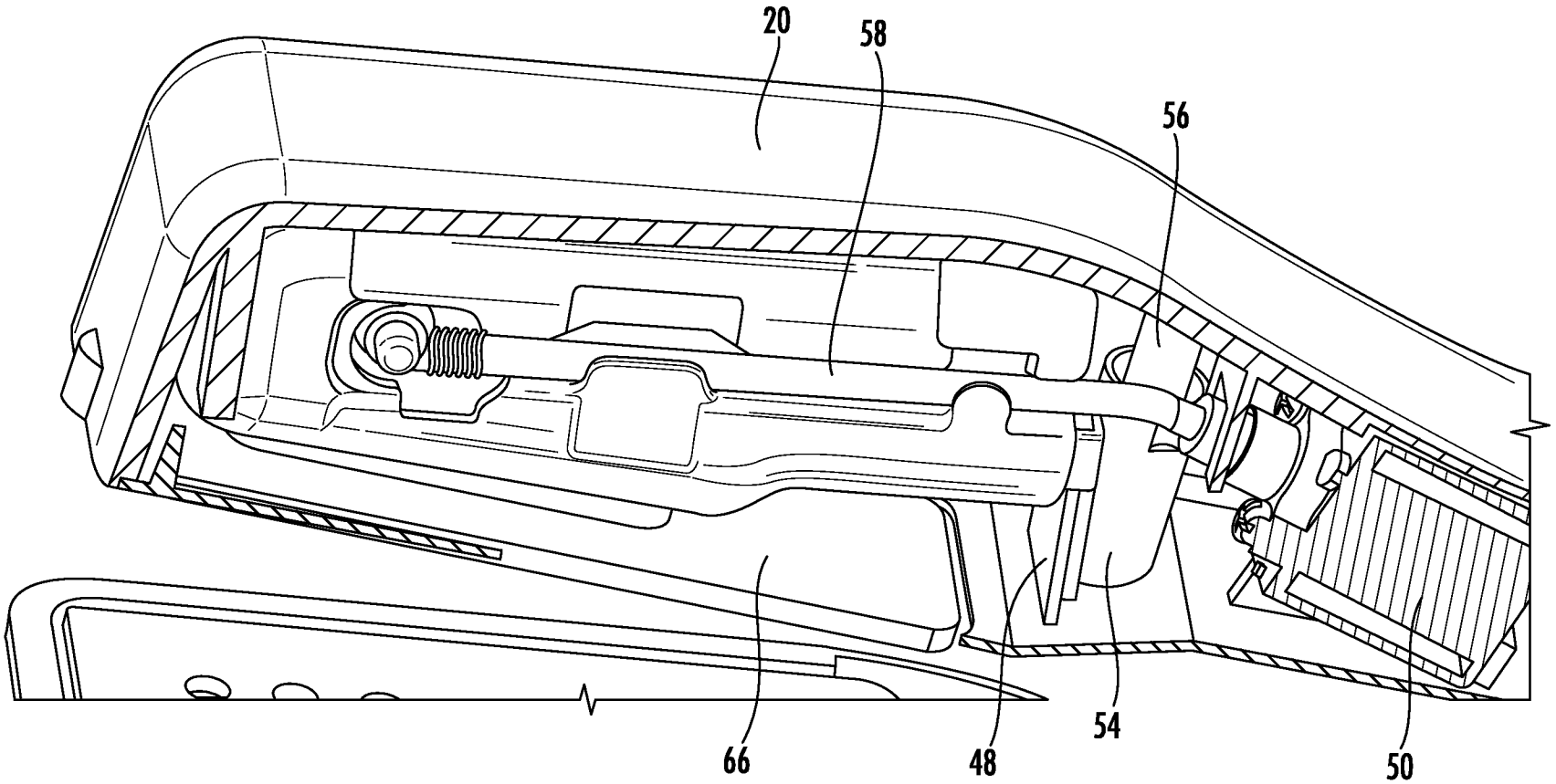
FIG. 10 is an enlarged partial section view of the steam generating unit and pump of the appliance of FIG. 1.

Referring still to FIGS. 4-6, a helical spring 46 is coiled around the pin 16. One end of the spring 46 engages the underside of the upper housing 20 within the reservoir 38. The opposite end of the spring 46 engages the lower arm 14. The spring 46 is configured to bias the upper and lower arms 12, 14 toward the open position of FIG. 1 and to resist movement toward the closed position of FIG. 2. Those skilled in this art will appreciate that other biasing components, such as a spring of a different configuration, repelling magnets, or the like, may be employed to bias the appliance 10 toward the open position.

As can be seen in FIGS. 4 and 5, the front floor 28 includes a vertical divider 48. A water pump 50 is located rearwardly of the divider 48 and is fluidly connected with the reservoir 38 via the hose 42. The water pump 50 can be of standard construction and need not be described in detail herein. A boss 54 is positioned just rearwardly of the divider 48 and receives a post 56 that depends from the upper housing 20.

A steam generation unit 60 is positioned forwardly of the divider 48. The steam generation unit 60 includes a heating element 62 (which is typically controlled by a thermostat or other temperature control device) and is fluidly attached to the pump 50 via a hose 58. At its lower end, the steam generation unit 60 has an exhaust manifold 64 that feeds onto a heating plate 66 mounted within the front floor 30. The lower surface of the heating plate 66 is exposed to the atmosphere. Exhaust holes 68 are present in the heating plate 66 and are separated from each other by baffles 70 in the exhaust manifold 64. Thus, steam produced by the steam generation unit 60 can be expelled through the exhaust manifold 64 and the exhaust holes 68 in the heating plate 66 (see FIGS. 3 and 7).

The lower arm 14 includes a lower housing 70 and a cover 72 that overlies the lower housing 70. A bearing plate 74 is mounted into the forward portion of the cover 72 above a window 76 in the lower housing 70. The bearing plate 74 includes exhaust holes 78 that, in the illustrated embodiment, are slightly larger than the exhaust holes 68 of the heating plate 66. The exhaust holes 78 are positioned so that, when the appliance 10 is in its closed position, the exhaust holes 78 substantially align with the exhaust holes 68 (see FIG. 7); i.e., the exhaust holes 68 at least partially overlap the exhaust holes 78 along an axis normal to the bearing plate 74. In some embodiment, the number of exhaust holes 68 matches the number of exhaust holes 78.

A vertical wall 80 extends upwardly from a rear region of the cover 72. The vertical wall 80 is located to extend into a notch in the rear floor 30 of the upper arm 12 when the appliance 10 is in the closed position. A switch 82 is mounted to a printed circuit board (PCB) 84 that is mounted below the cover 72 rearwardly of the vertical wall 80; the switch 82 extends upwardly through a window 86 in the cover 72. The switch 82 is operationally connected with the water pump 50 and the steam generation unit 60. The switch 82 and/or the PCB may be configured so that, when the switch 82 is activated, the water pump 50 and steam generation unit 60 are immediately activated, or one or the other of the water pump 50 and steam generation unit 60 may be time-delayed slightly before activating.

A power cord 90 is mounted in the rear end wall 24 of the upper housing 20. The power cord 90 is operationally connected with the switch 82, the water pump 50, and the steam generating unit 60.

As discussed above, the appliance 10 has the capability of being operated as a handheld garment pressing device. Prior to use a user fills the water reservoir 38 with water. The user then activates the appliance 10 (either by simply plugging the power cord 90 into an electrical socket, or by actuating an "on-off" mechanism, such as a button, toggle switch, or the like) to initiate operation. In some embodiments this action may activate the heating element 62 to begin to heat up, while in other embodiments heating of the heating element 62 is activated by the switch 82 as described below. As the heating element 62 heats up, it causes the temperature of the heating plate 66 to rise.

With the appliance 10 turned on and the water reservoir 38 filled, the user then places the item to be pressed between the upper and lower heating plates 66, 74, then squeezes the upper and lower arms 12, 14 together to press the upper and lower heating plates 66, 74 against the item. When the upper and lower arms 12, 14 are drawn together, the lower surface of the rear floor contacts the switch 82 and forces it downwardly. If the heating element is not already heating due to initial activation, this action activates the heating element 62 of the steam generation unit 60. In either event, the heat from the heating plate 66 and the pressure exerted on the item from the heating plate 66 and the bearing plate 74 can remove wrinkles from the item. In many instances, the user may wish to slide the item between the heating and bearing plates 66, 74 as they are pressed against the item, which can mimic the pressing action of a conventional iron.

In addition, compression of the upper and lower arms 12, 14 to activate the switch 82 also induces the steam generation unit 60 to provide steam to the item. Upon activation of the switch 82, the water pump 50 is activated, such that the water from the reservoir 38 is pumped via the water pump 50 through the hose 42, the pump 50, and the hose 58 into the steam generation unit 60. Inside the steam generation unit 60, the water is converted to steam by the heating element 62. Steam is then expelled from the steam generation unit 60 through the exhaust holes 68 and onto the item as the item is held between the heating and bearing plates 66, 74.

If, alternatively, the user wishes to operate the appliance 10 as a handheld steamer, the user can compress the upper and lower arms 12, 14 together in the manner described above, which activates the steam generation unit 60. Because of the presence of the exhaust holes 78 in the bearing plate 74, when steam is generated with the appliance 10 in the closed position described above without an item between the heating and bearing plates 66, 74, steam passes through both the exhaust holes 68 in the heating plate 66 and the exhaust holes 78 in the bearing plate 74. Thus, by holding the appliance 10 with the bearing plate 74 facing an item to be steamed, a user can use the appliance 10 to steam wrinkles from the item.

It can therefore be seen that the appliance 10 can provide both handheld ironing and handheld steaming capability in a single device. The dual-function nature of the device can provide convenience to the user. As one example, some garments (e.g., a man's dress shirt or woman's dress) are large enough that regions in the center of the garment cannot be reached by the upper and lower arms 12, 14. For such garments, wrinkles may be removed from the center of the garment by steaming Thus, the user can remove wrinkles from the entire garment with a single device.

Those of skill in this art will appreciate that the appliance 10 may take other forms. For example, in some embodiments the bearing plate 74 in the lower arm 14 may be heated, in order to provide two heated surfaces for pressing.

In some embodiments, the appliance 10 may include a separate switch, button or other activation device to activate the water pump 50, such that the heating element 62 may provide heat to the heating plate 68 without steam when desired by the user. As another option, the steam generation unit 60 may not be operatively connected with the switch 82, such that simply activating the appliance 10 (by plugging it into an electrical outlet or turning on an on-off switch) activates the heating element 62 to begin producing heat. As a further option, the appliance 10 may be powered via replaceable or rechargeable batteries rather than via the power cord 90.

Also, there may be more or fewer exhaust holes 68 than exhaust holes 78, and/or some of the exhaust holes 68 may not be substantially aligned with a respective exhaust hole 78. For example, the exhaust holes 68 may be arranged in a pattern that is beneficial for steam ironing, whereas a different pattern for the exhaust holes 78 may be beneficial for steaming. In such instances, the beating plate 74 may include channels or slots that enable steam exiting the exhaust holes 68 to reach any exhaust holes 78 that are not substantially aligned with a respective exhaust hole 68. The exhaust holes 68, 78 are shown as being round, but may be of any shape, including oval, elliptical, square, slotted, or the like.

As another variation, in some embodiments the upper arm 12 may not be pivotally attached to the lower arm 14, but may be attached in some other manner that enables the heating plate 66 to be moved from a position in which the heating plate 66 is separated from the bearing plate 74 (i.e., an open position) to a position in which the heating plate 66 is closely adjacent to and confronts the bearing plate 74 (i.e., a closed position). For example, the upper arm 12 may be attached to the lower arm 14 via a telescoping mechanism, an "accordion" mechanism, or the like that allows the upper arm 12 to come together with and separate from the lower arm 14.

In still another variation, the water reservoir 38 may be located in the lower arm 14 rather than the upper arm 12, or may be located in both the upper arm 12 and the lower arm 14.

Figure 12:
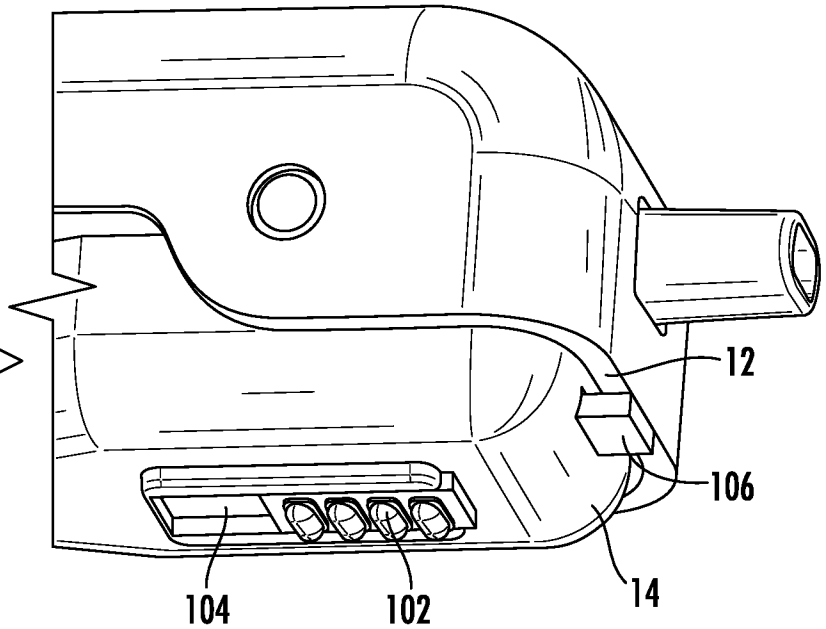
FIG. 12 is an enlarged partial side view of the locking mechanism of FIG. 11 shown in a locked condition.
Figure 11:
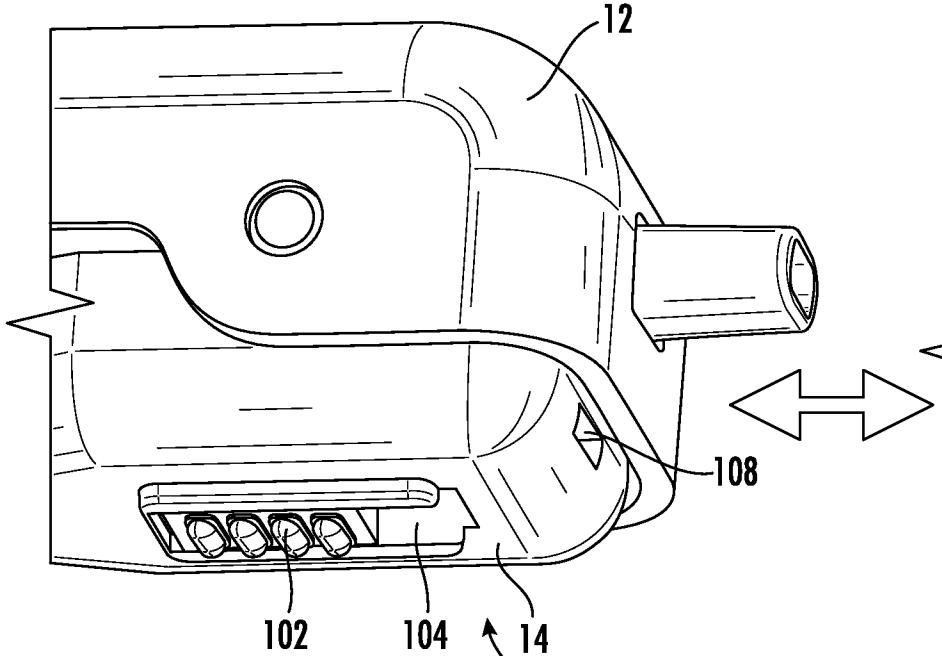
FIG. 11 is an enlarged partial side view of the appliance of FIG. 1 with a locking mechanism for locking the appliance in the closed position, wherein the mechanism is shown in an unlocked condition.
Figure 13:
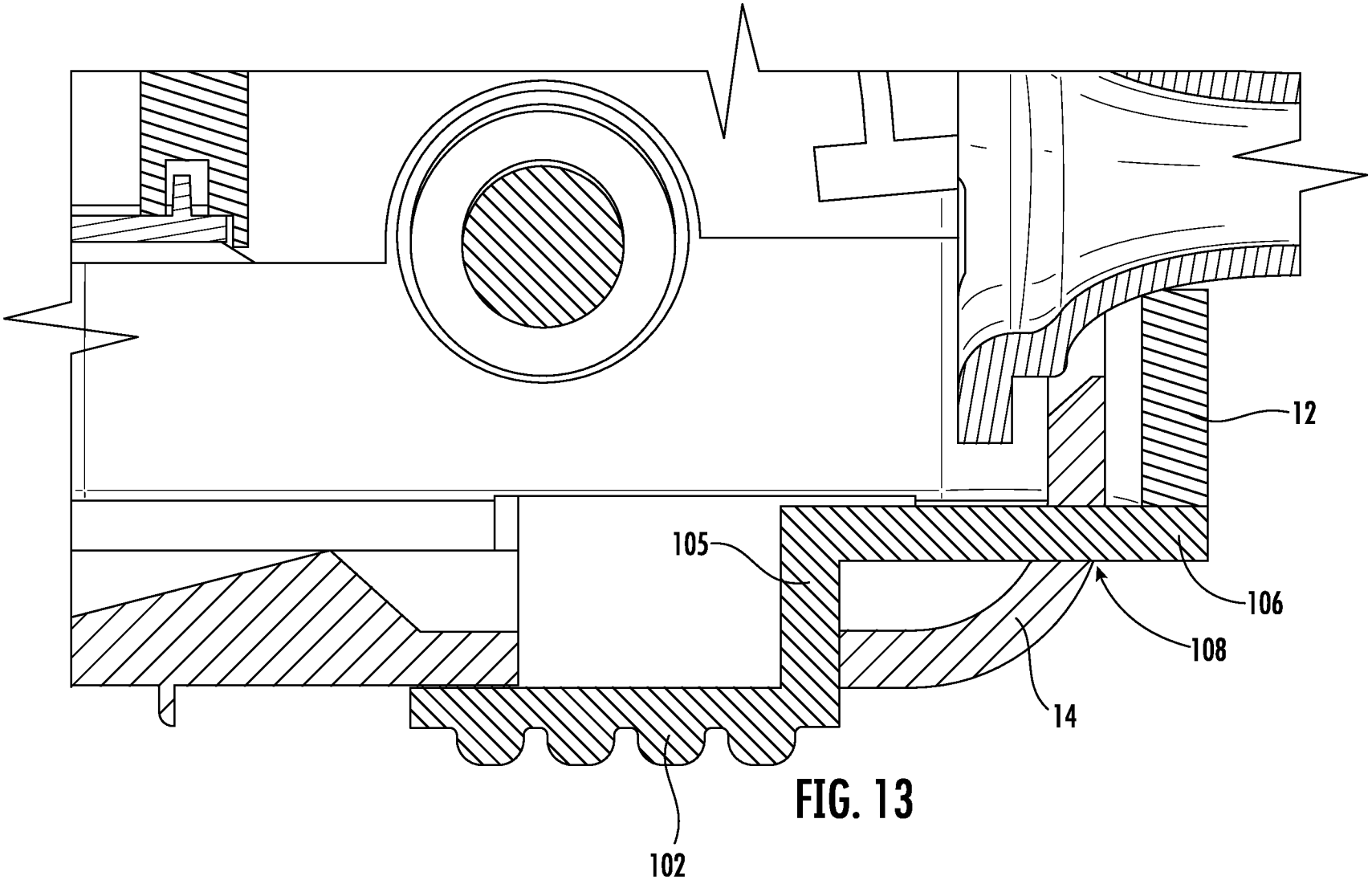
FIG. 13 is an enlarged partial section view of the locking mechanism of FIG. 11 shown in the locked condition.

In a further variation, the appliance 10 may include a locking device (such as a pivoting clip, a flexible latch, or the like) that maintains the appliance in the closed position. One such locking mechanism 100 is shown in FIGS. 11-13. The locking mechanism 100 includes a sliding switch 102 that is slidably mounted in an aperture 104 in the lower arm 14. The switch 102 is attached via a vertical panel 105 to a finger 106 that can extend through or retract from a slot 108 in the rear end of the lower arm 14. When the switch 102 is in the forward end of the aperture 104 (as in FIG. 11), the finger 106 is retracted within the slot 108, thereby allowing the upper arm 12 to pivot relative to the lower arm 14. When the switch 102 is moved to the rearward end of the aperture 104 (as in FIGS. 12 and 13), the finger 106 extends through the slot 108 and is positioned below the lower edge of the upper arm 12; in this position, engagement of the finger 106 with the upper arm 12 prevents pivotal movement of the upper arm 12 relative to the lower arm 14.

When the locking mechanism is in the locked condition of FIGS. 12 and 13, the appliance 10 may be operated as a steamer without the user having to continue to hold the appliance 10 in the closed position during steaming. This freedom may permit easier or more comfortable steaming.

Another exemplary embodiment of a handheld pressing and steaming appliance is shown in FIGS. 14-26 and designated broadly therein at 210. Similar to the appliance 10, the appliance 210 includes an upper arm 214 and a lower arm 216 that is pivotally attached to the upper arm 214. The upper and lower arms 214, 216 are free to pivot relative to each other about a pivot 218 between an open position (shown in FIG. 14) and a closed position (shown in FIG. 15). In the open position of FIG. 14, the appliance 210 is free to receive a garment or other item to be pressed between heating and bearing plates 266, 274 in the arms 214, 216. In the closed position of FIG. 15, the appliance 210 can be used to press wrinkles from a garment or other item residing between the heating and bearing plates 266, 274, or may be employed as a handheld steamer. Some of the differences between the appliance 10 and the appliance 210 are described in greater detail below.

Figure 15:
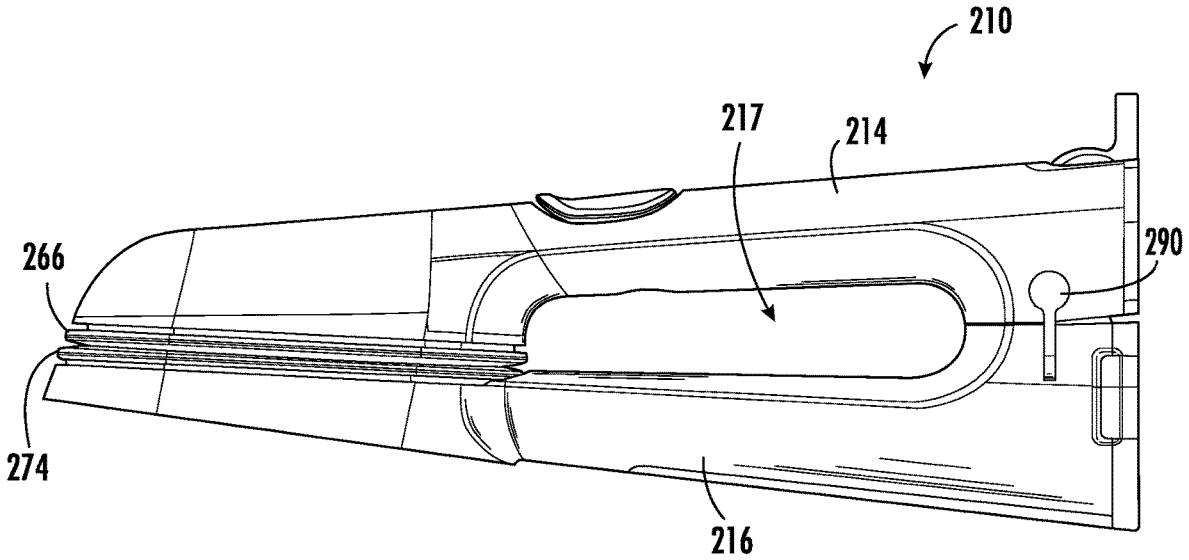
FIG. 15 is a side view of the appliance of FIG. 14 shown in the closed, locked position.

Referring to FIG. 15, it can be seen that the upper and lower arms 214, 216 are configured so that a vacant space 217 is present between the upper and lower arms 214, 216 when the appliance 210 is in the closed position. The presence of this vacant space 217 can enable a user to grasp the appliance 210 with his fingers and thumb extending into the vacant space 217 from opposite sides and his palm on the upper surface of the upper arm 214. This grasping position may facilitate positioning and repositioning of the appliance 210 during use.

Figure 16:
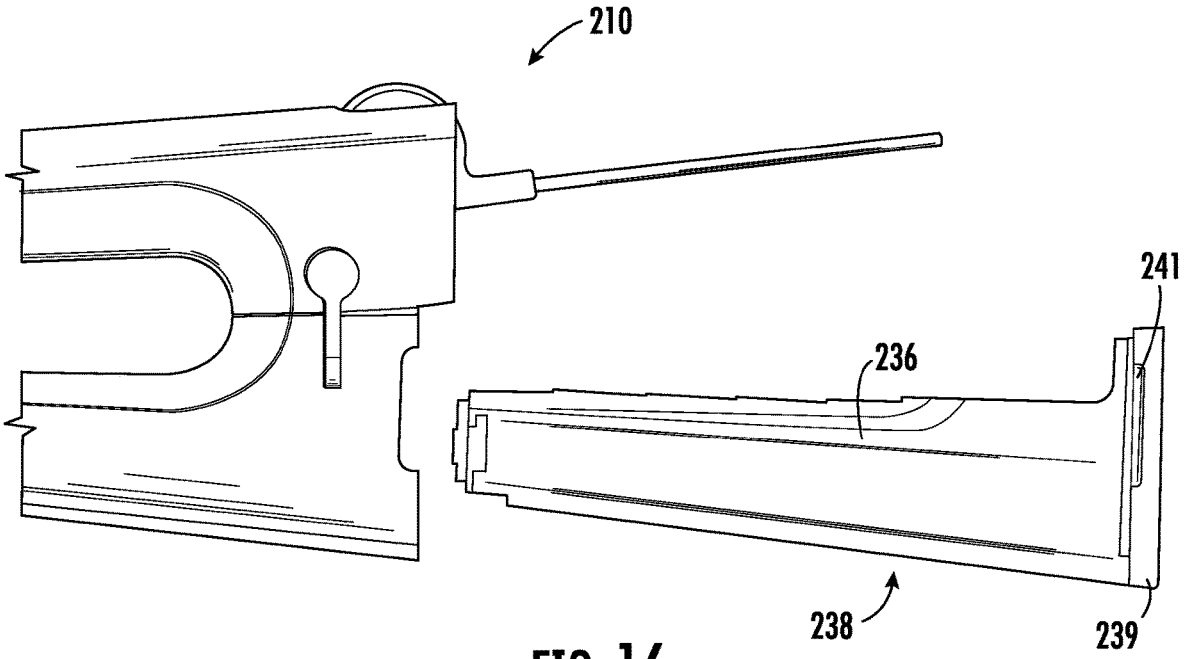
FIG. 16 is a partial exploded side view of the appliance of FIG. 14 with the water reservoir removed.
Figure 17:
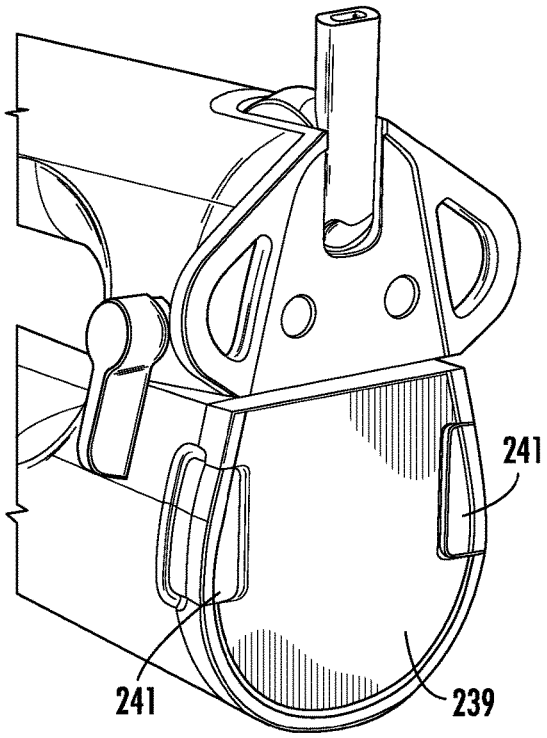
FIG. 17 is a partial rear perspective view of the appliance of FIG. 14.
Figure 18:
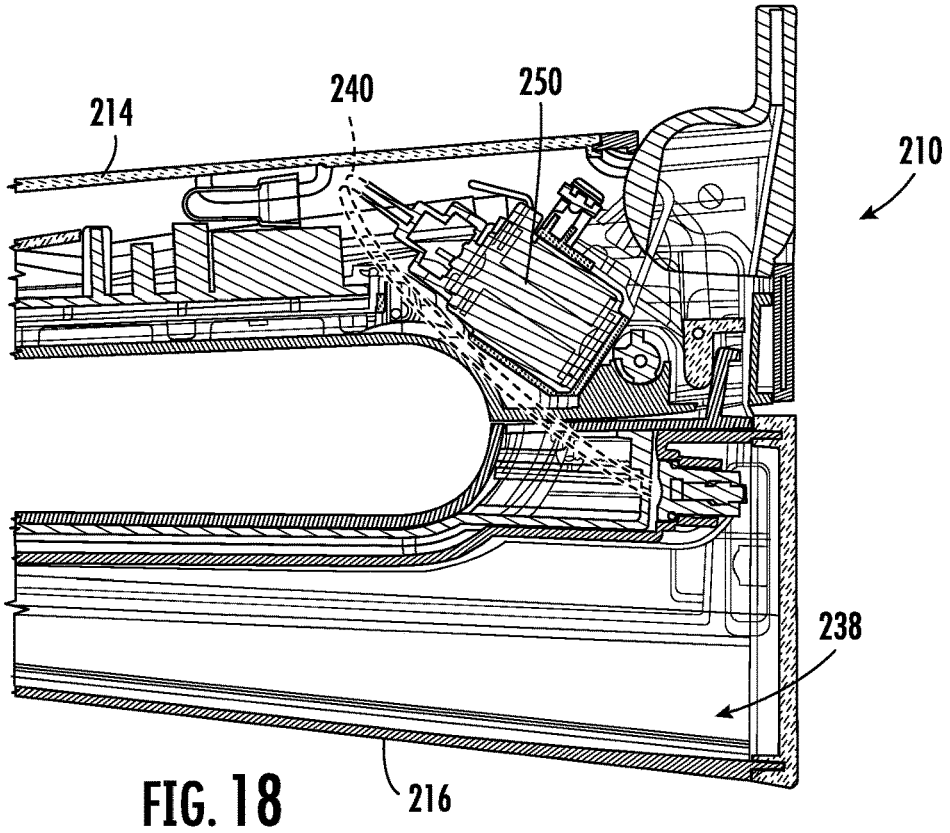
FIG. 18 is a partial side section view of the appliance of FIG. 14.
Figure 19:
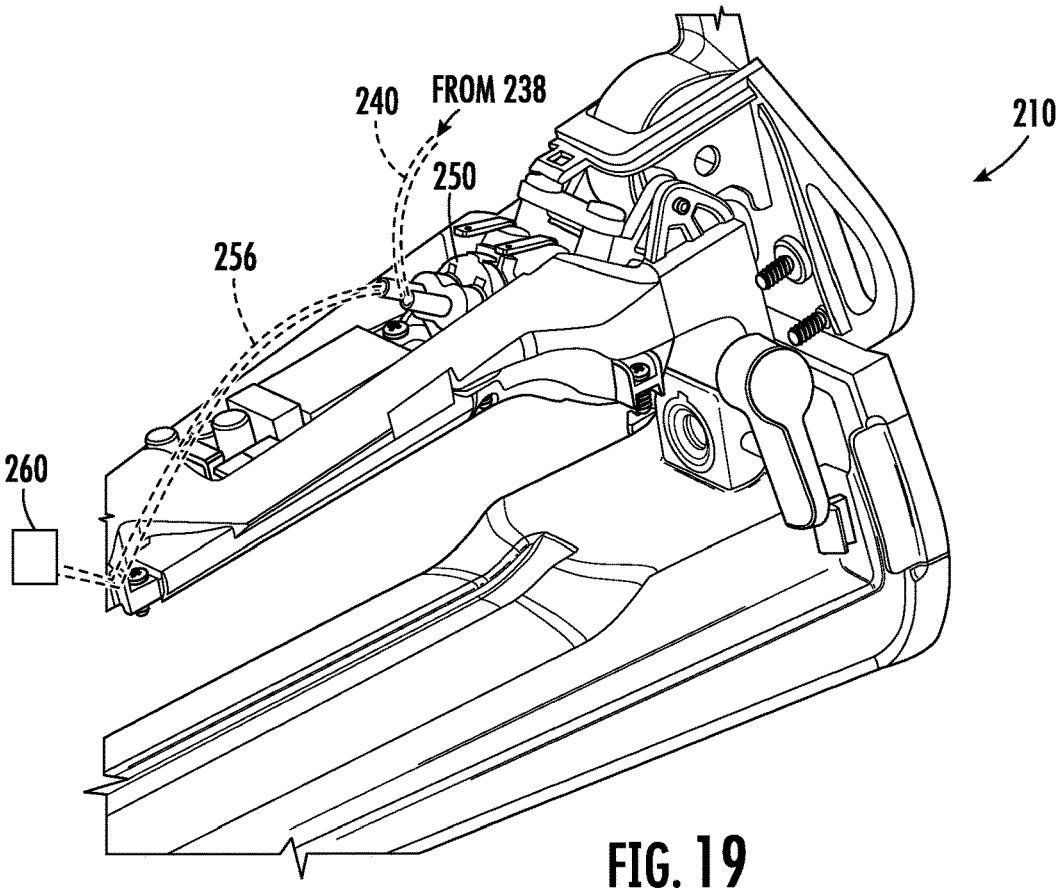
FIG. 19 is a partial cutaway front perspective view of the appliance of FIG. 14.

Referring now to FIGS. 16-18, the appliance 210 includes a water reservoir 238 that is a separate, removable component (see FIG. 16, which illustrates the water reservoir 238 removed from the appliance 210). The water reservoir 238 includes an elongated tank 236 that fits within the lower arm 216. A cover 239 fits over and seals the open (rear) end of the tank 236. As shown in FIG. 17, the water reservoir 238 is held in place by two snap-fit latches 241 mounted on the sides of the lower arm 216 that engage the cover 239.

The water reservoir 238 is fluidly connected to an inlet of a pump 250 that is mounted in the upper arm 214 via a line 240 (shown schematically in FIG. 18). An outlet of the pump 250 is then fluidly connected via a line 256 (shown schematically in FIG. 19) with a steam generation unit 260 similar to the steam generation unit 60 described above. The steam generation unit 260 provides steam for both ironing and steaming as described above.

Figure 14:
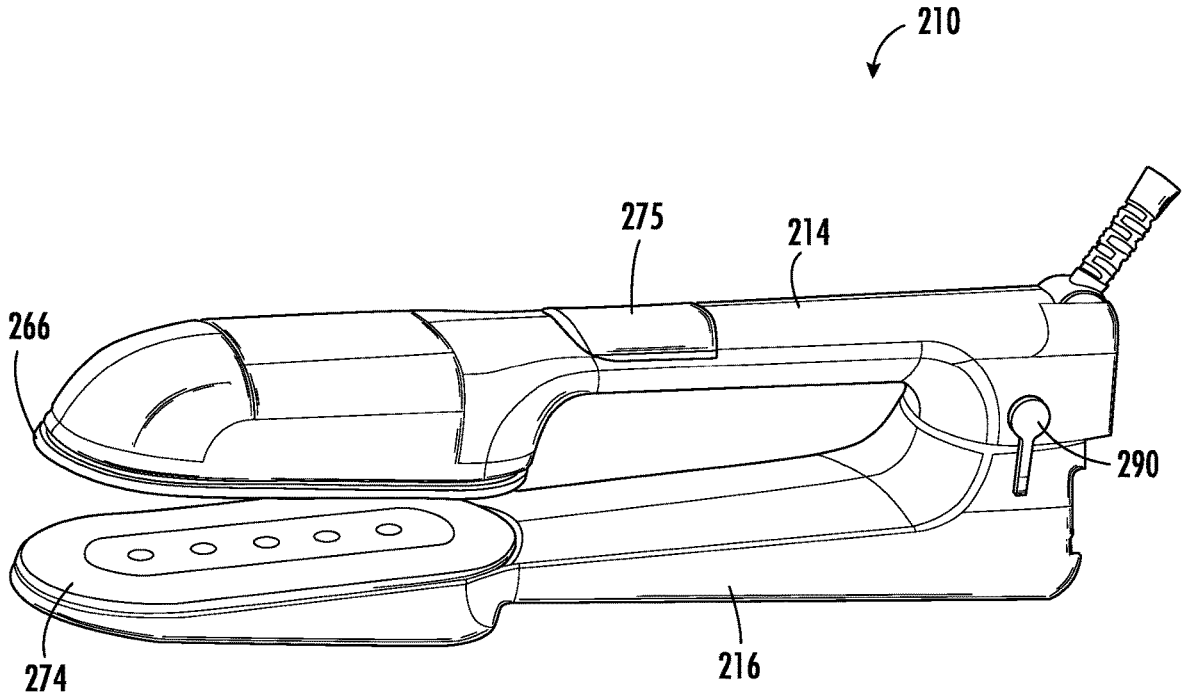
FIG. 14 is a side perspective view of a handheld pressing and steaming appliance according to further embodiments of the invention, shown in its open position.

Referring now to FIGS. 19-26, the appliance 210 is configured to be capable of being locked in the closed position of FIG. 15 for steaming, or operated in an unlocked condition in which the user can freely and easily move the appliance 210 between the open position of FIG. 14 and the closed position of FIG. 15 during operation. A closing mechanism 270 is included in the appliance 210 to induce pivoting of the upper arm 214 relative to the lower arm 216 about a pivot 218 to move the appliance 210 to the closed position. Also, a selection lever 290 serves as a locking mechanism to maintain the appliance 210 in the locked position. The closing mechanism 270 and the selection lever 290 are discussed below.

Figure 20:
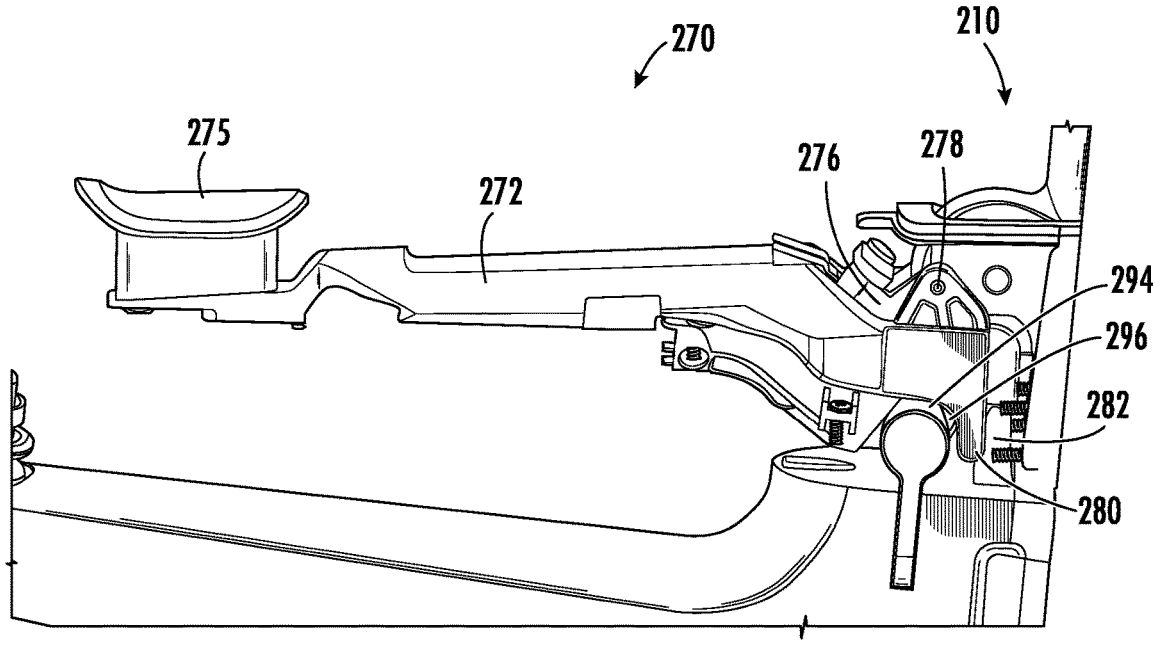
FIG. 20 is a side view of the closing mechanism and the selection lever of the appliance of FIG. 14, with the selection lever shown in the locked position.
Figure 21:
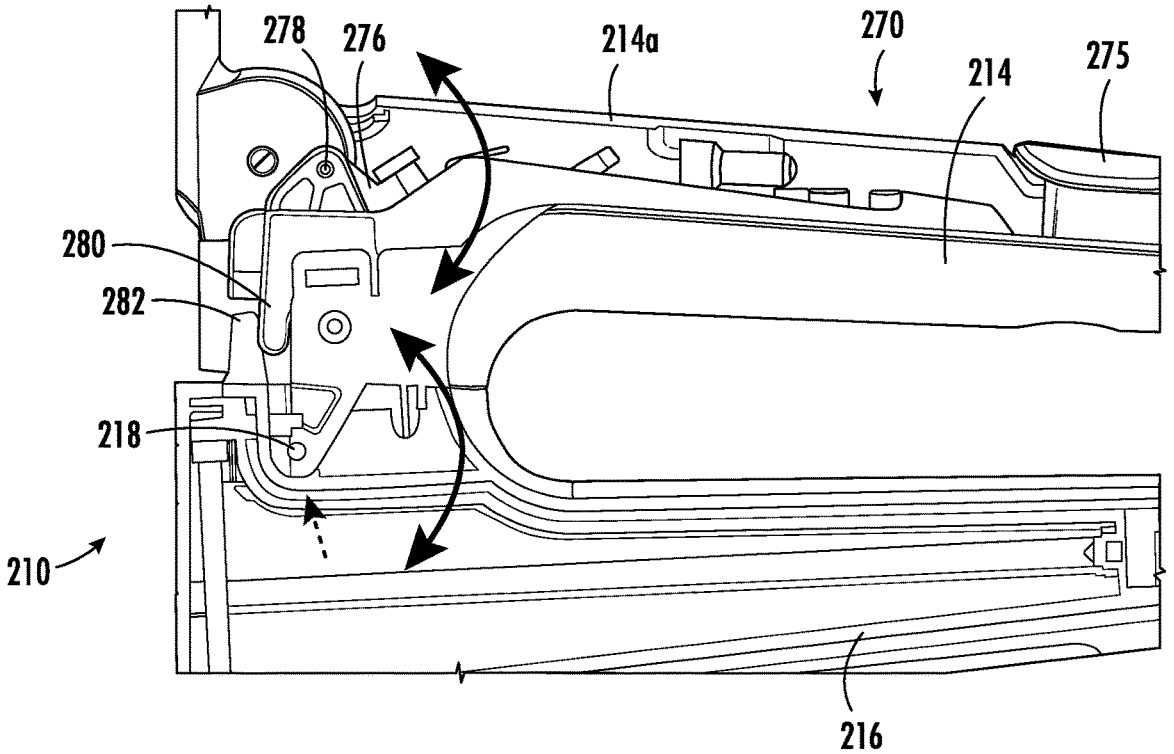
FIG. 21 is a partial side view of the closing mechanism of the appliance of FIG. 14.
Figure 22:
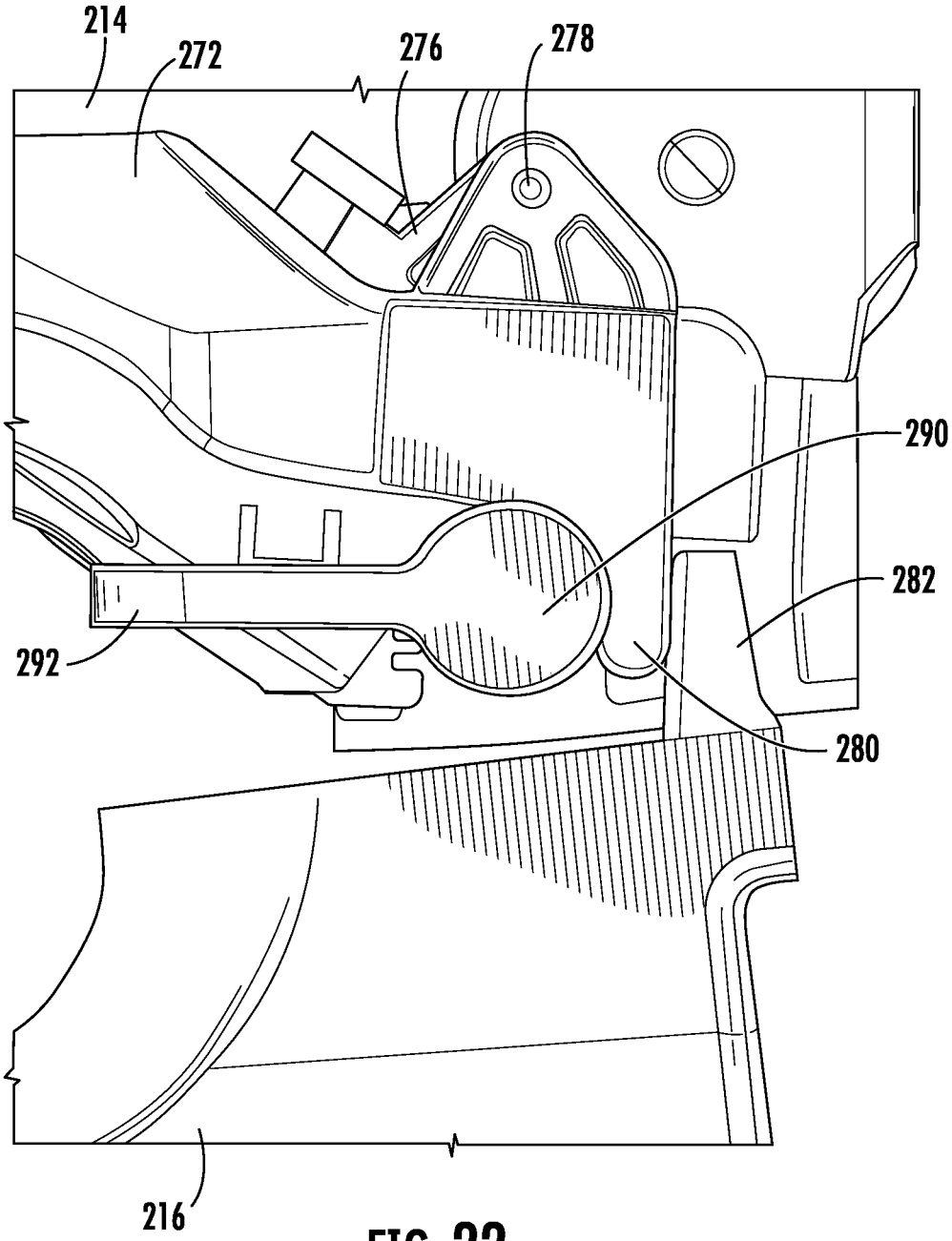
FIG. 22 is a greatly enlarged partial cutaway side view of the closing mechanism and selection lever of the appliance of FIG. 14, with the selection lever shown in the unlocked position and the appliance shown in the open position.

As shown in FIG. 20, the closing mechanism 270 includes an elongate locking member 272 that extends rearwardly from a central area within the upper arm 214. A push button 275 is attached adjacent the front end of the locking member 272 and extends through the housing **214*a* of the upper arm 214. Near its rear end, the locking member 272 is attached to a foundation member 276 at a pivot 278. The foundation member 276 is fixed relative to the housing 214*a* of the upper arm 214. At its rear end, the locking member 272 includes a downwardly-extending finger 280. A bearing panel 282 extends upwardly from the upper surface of the rear end of the lower arm 216 just rearwardly of the finger 280. The pivot 218 between the upper and lower arms 214, 216 is located forwardly and downwardly from the bearing panel 282**.

The selection lever 290 is mounted on the rear end portion of the upper arm 214 (see FIGS. 20-24). The selection lever 290 includes a handle 292 that is positioned laterally of the upper arm 214. An axle 294 extends transversely from the handle 292 through the upper arm 214. As can be seen in FIGS. 20-23, the axle 294 is mostly circular in profile, but includes a nub 296 that extends radially outwardly from the surface of the axle 294.

As noted above, the closing mechanism 270 can be employed to temporarily move the upper and lower arms 214, 216 to the closed position for ironing or steaming; when moved to the closed position, with the closing mechanism 270, the appliance 210 can easily be returned to the open position by simply releasing the closing mechanism 270. Alternatively, the selection lever 290 is employed to lock the upper and lower arms 214, 216 of the appliance 210 in the closed position. In the open position of FIG. 14 and FIG. 22, the forward end of the upper arm 214 is separated from the forward end of the lower arm 216, with the result that the heating plate 266 and the bearing plate 274 are separated. The selection lever 290 is rotated so that the handle extends forwardly from the axle 294, with the result that the nub 296 faces downwardly. The locking member 272 is pivoted such that the finger 280 either does not engage the bearing panel 282 or applies virtually no rearward force against the bearing panel 282. In this arrangement, the upper arm 214 is free to pivot relative to the lower arm 216, such that the user can open and close the heating plate 266 and the bearing plate 274 (for example, to insert a garment to be ironed between the plates 266, 274).

Figure 23:
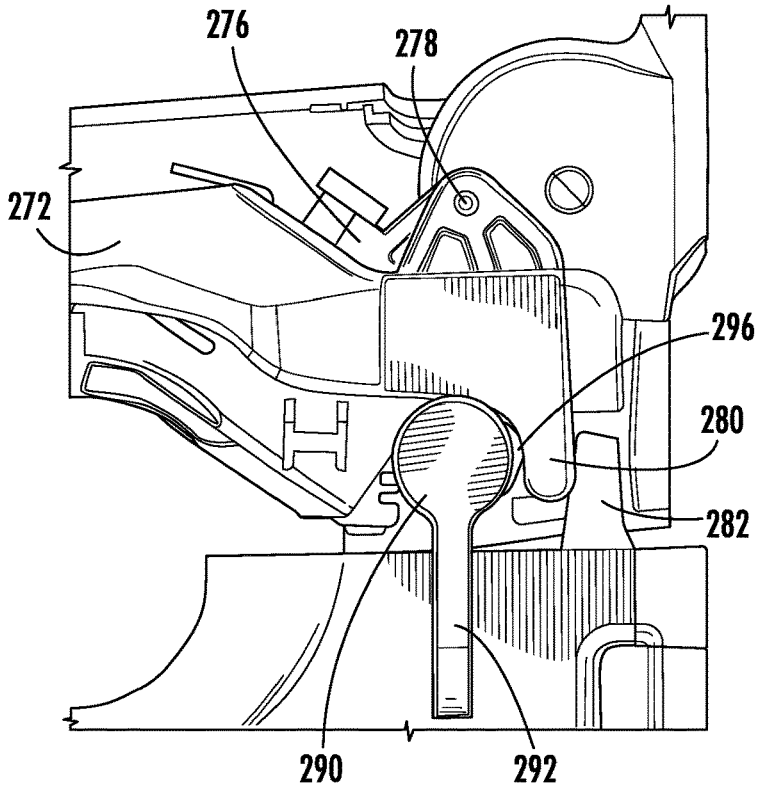
FIG. 23 is a greatly enlarged partial cutaway side view of the closing mechanism and selection lever of the appliance of FIG. 14, with the selection lever shown in the locked position.

If the user wishes to lock the appliance 210 into the closed position (for example, to use the appliance 210 as a steamer), the user moves the handle 292 of the selection lever 290 so that it points downwardly (FIG. 23). This movement rotates the axle 294 of the selection lever 290 so that the nub 296 engages the forward surface of the finger 280 of the locking member 272. Engagement of the finger 280 by the nub 296 forces the finger 280 rearwardly, which in turn forces the locking member 272 to pivot (counterclockwise from the vantage point of FIG. 23) about the pivot 278. The rearward movement of the finger 280 forces the bearing panel 282 rearwardly. The rearward movement of the bearing panel 282 rotates the lower arm 216 relative to the upper arm 214 about the pivot 218 to force the heating plate 266 against the bearing plate 274. The contact position and angle of the nub 296 on the bearing panel 282 maintain (i.e., lock) the appliance 210 in the closed position. The user can then operate the appliance 210 as a steamer without having to further manipulate the appliance 210 to maintain the appliance 210 in the closed position.

Figure 24:
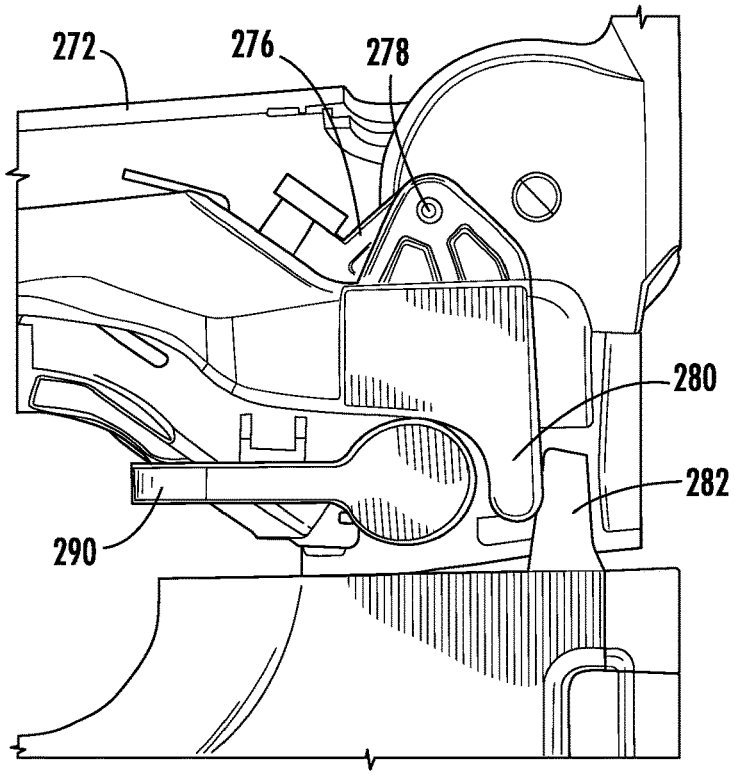
FIG. 24 is a greatly enlarged partial cutaway side view of the closing mechanism and selection lever of the appliance of FIG. 14, with the selection lever shown in the unlocked position and the closing mechanism shown in the closed position.
Figure 25:
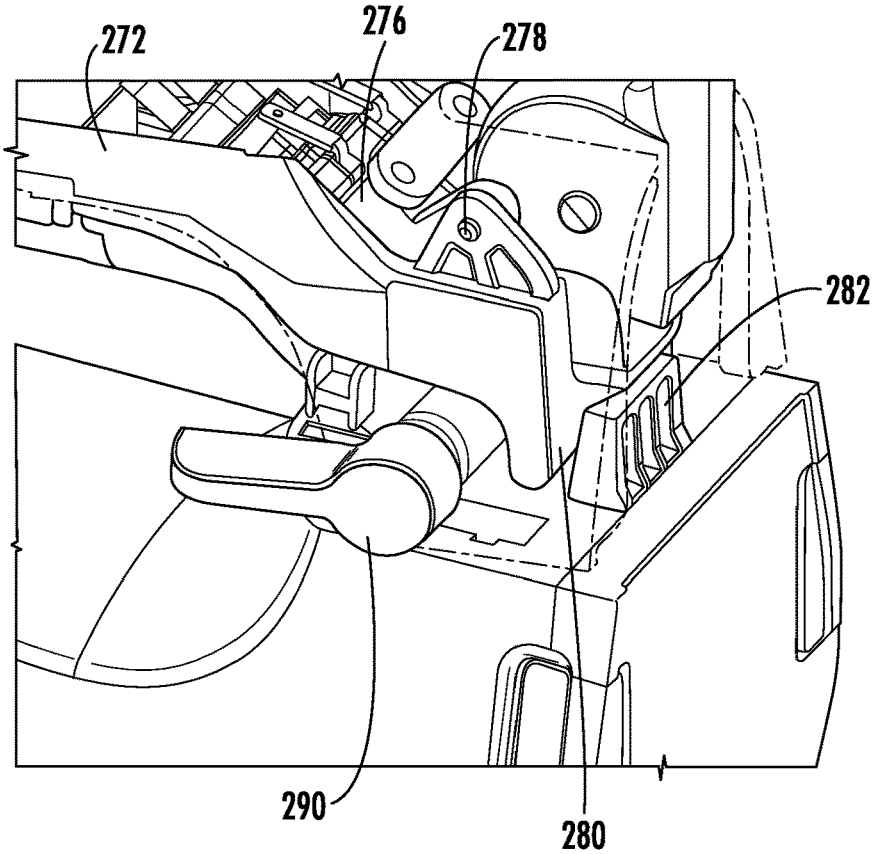
FIG. 25 is a greatly enlarged partial cutaway side perspective view of the closing mechanism and selection lever of the appliance of FIG. 14, with the selection lever shown in the unlocked position and the appliance shown in the closed position.
Figure 26:
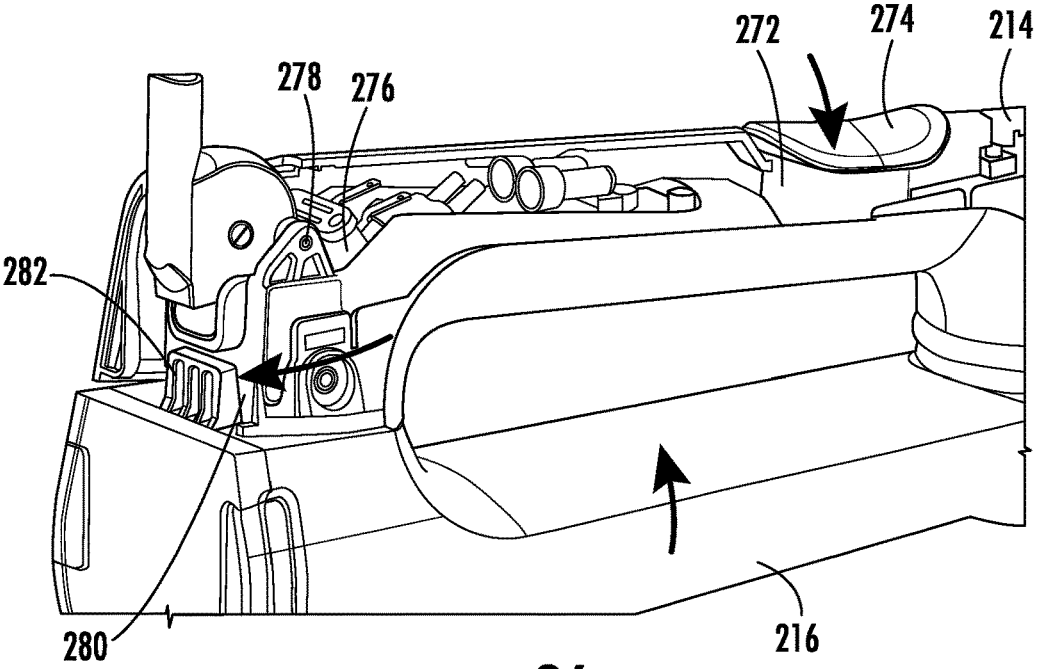
FIG. 26 is a partial side perspective view of the appliance of FIG. 14 showing the closing action of the closing mechanism.

The appliance 210 can be released from the locked position by simply rotating the handle 292 of the selection lever to its original position (see FIG. 24). A spring (not shown) that acts on the pivot 218 biases the upper and lower arms 214, 216 toward the open position. As such, once the selection lever 290 moves to the unlocked position, the appliance 210 returns to the open position.

As noted above, the closing mechanism 270 can be used to move the appliance 210 from the open position to the closed position without locking the appliance 210 in the closed position. This capability may be desirable if the user wishes to both iron and steam a garment intermittently.

The user can employ the closing mechanism 270 by pushing the push button 275 downwardly. This movement rotates the locking member 270 relative to the foundation member 276 about the pivot 278 (counterclockwise from the vantage point of FIGS. 20 and 22). This action forces the finger 280 of the locking member 272 into the bearing panel 282 and drives it rearwardly. The rearward movement of the bearing panel rotates the lower arm 216 relative to the upper arm 214 about the pivot 218, thereby drawing the heating plate 266 and the bearing plate 274 together. In this position the appliance can be used for brief steaming, or can be used to iron a garment that is positioned between the heating and bearing plates 266, 274.

Release of the push button 275 can allow the closing mechanism 270 to reverse and allow the appliance 210 to take the open position. A spring (not shown) associated with the pivot 278 can urge the locking member 272, and therefore the push button 275, to their original positions. The aforementioned spring associated with the pivot 218 urges the upper and lower arms 214, 216 to separate.

As with the appliance 10 discussed above, the appliance 210 may be configured so that the pump 250 automatically activates (via a switch or the like) when the appliance is moved to the closed position (whether via the selector lever 290 or the closing mechanism 270), which can allow the user to always have steam available for either steaming or ironing. Activation of the pump 250 causes water to be conveyed from the reservoir 238 through the pump 250 and to the steam generation unit 260. Inside the steam generation unit 260, the water is converted to steam, which is then expelled from the steam generation unit 260 through the exhaust holes of the heating plate 266 (and during steaming through the holes in the and bearing plate 274) in the manner described above in connection with the appliance 210.

In some embodiments, the appliance 210 may be configured so that, once the pump 250 is activated and steam is produced, the pump 250 remains activated for at least a minimum duration (e.g., 30 seconds) even if the appliance 210 is moved back to the open position. This can enable a user to briefly release the push button 275, then re-engage it, without the generation of steam being interrupted.

Some embodiments of the present invention are exemplarily described above in combination with the accompanying drawings. Those of ordinary skill in the art to which the present invention belongs should understand that specific structures shown in the above embodiments are merely exemplary, rather than limiting. Moreover, those of ordinary skill in the art to which the present invention belongs can combine a variety of technical features shown above according to a variety of possible manners to constitute new technical solutions or make other modifications, and these new technical solutions are encompassed within the scope of the present invention.

That which is claimed is:

1. A handheld pressing and steaming appliance, comprising:

an upper arm;

a lower arm attached at one end to an end of the upper arm;

a steam generation unit mounted on the upper arm;

a water reservoir located in the upper arm and/or the lower arm;

a water pump fluidly connected to the water reservoir and to the steam generation unit;

a heating plate mounted near a free end of the upper arm, the heating plate including a plurality of first exhaust holes that are in fluid communication with the steam generation unit; and a bearing plate mounted on the lower arm at a free end thereof, the bearing plate including a plurality of second exhaust holes;

wherein the appliance is movable between an open position, in which the heating plate and the bearing plate are separated from each other, and a closed position, in which the heating plate and the bearing plate are closely adjacent to and confront each other;

wherein in the closed position at least one of the second exhaust holes is substantially aligned with a respective one of the first exhaust holes, such that steam exhausted from the respective one of the first exhaust holes also passes through the at least one second exhaust hole; and wherein the appliance further comprises a closing mechanism attached to at least one of the upper and lower arms, the closing mechanism configured to releasably move the appliance to the closed position, further comprising a switch positioned on one of the upper and lower arms, the switch operatively connected with the pump, wherein movement of the appliance to the closed position causes the switch to activate the pump.

2. The appliance defined in claim 1, wherein in the closed position each of the plurality of second exhaust holes is substantially aligned with a respective first exhaust hole.

3. The appliance defined in claim 1, wherein the appliance includes a biasing member that engages the upper and lower arms and biases the appliance toward the open position.

4. The appliance defined in claim 1, wherein the steam generation unit includes a heating element, and wherein the heating element is positioned to heat the heating plate.

5. The appliance defined in claim 1, wherein the at least one first exhaust hole is smaller in diameter than the at least one second exhaust hole.

6. The appliance defined in claim 1, wherein the upper arm is pivotally attached to the lower arm.

7. The appliance defined in claim 1, further comprising a locking mechanism attached to at least one of the upper and lower arms, the locking mechanism configured to lock the appliance in the closed position.

8. A handheld pressing and steaming appliance, comprising:

an upper arm;

a lower arm pivotally attached at one end to an end of the upper arm at a pivot;

a steam generation unit mounted on the upper arm;

a water reservoir located in the lower arm;

a water pump fluidly connected to the water reservoir and to the steam generation unit;

a heating plate mounted near a free end of the upper arm opposite the pivot, the heating plate including a plurality of first exhaust holes that are in fluid communication with the steam generation unit;

a bearing plate mounted on the lower arm at a free end opposite the pivot, the bearing plate including a plurality of second exhaust holes;

wherein the appliance is pivotable between an open position, in which the heating plate and the bearing plate are separated from each other, and a closed position, in which the heating plate and the bearing plate are closely adjacent to and confront each other; and wherein in the closed position each of the second exhaust holes is substantially aligned with a respective one of the first exhaust holes, such that steam exhausted from each of the first exhaust holes also passes through a corresponding one of the second exhaust holes, further comprising a switch positioned on one of the upper and lower arms, the switch operatively connected with the pump, wherein movement of the appliance to the closed position causes the switch to activate the pump.

9. The appliance defined in claim 8, wherein the appliance includes a biasing member that engages the upper and lower arms and biases the appliance toward the open position.

10. The appliance defined in claim 8, wherein the steam generation unit includes a heating element, and wherein the heating element is positioned to heat the heating plate.

11. The appliance defined in claim 8, wherein the first exhaust holes are smaller in diameter than the second exhaust holes.

12. The appliance defined in claim 8, further a locking mechanism attached to at least one of the upper and lower arms, the locking mechanism configured to lock the appliance in the closed position.

13. The appliance defined in claim 8, further comprising a closing mechanism attached to at least one of the upper and lower arms, the closing mechanism configured to releasably move the appliance to the closed position.

* * * * *